US010654691B2

(12) United States Patent
Rios

(10) Patent No.: US 10,654,691 B2
(45) Date of Patent: May 19, 2020

(54) OVERHEAD CRANE WITH REMOTELY LOCATED WINCH

(71) Applicant: FORUM US, INC., Houston, TX (US)

(72) Inventor: Rogelio Rios, Spring, TX (US)

(73) Assignee: FORUM US, INC., Houston, TX (US)

( * ) Notice: Subject to any disclaimer, the term of this patent is extended or adjusted under 35 U.S.C. 154(b) by 120 days.

(21) Appl. No.: 15/902,693

(22) Filed: Feb. 22, 2018

(65) Prior Publication Data

US 2019/0256327 A1 Aug. 22, 2019

(51) Int. Cl.

| | |
|---|---|
| ***B66C 19/00*** | (2006.01) |
| ***E21B 15/00*** | (2006.01) |
| ***B66C 17/00*** | (2006.01) |
| ***B66C 23/60*** | (2006.01) |
| ***B66C 11/00*** | (2006.01) |
| ***B66C 11/16*** | (2006.01) |
| ***B66C 6/00*** | (2006.01) |

(52) U.S. Cl.

CPC ..... *B66C 11/16* (2013.01); *B66C 6/00* (2013.01); *B66C 11/00* (2013.01); *B66C 17/00* (2013.01); *B66C 19/00* (2013.01); *B66C 23/60* (2013.01); *E21B 15/00* (2013.01)

(58) Field of Classification Search

CPC ..... B66C 19/00; B66C 19/002; B66C 19/005; B66C 19/007; B66C 19/02; B66C 23/00; B66C 23/36; B66C 23/60; B66C 11/00; E21B 15/00

See application file for complete search history.

(56) References Cited

U.S. PATENT DOCUMENTS

| | | | | |
|---|---|---|---|---|
| 4,279,347 | A * | 7/1981 | Appleman | B66C 19/007 212/274 |
| 4,284,159 | A * | 8/1981 | Voelz | B66C 19/007 180/414 |
| 4,358,020 | A * | 11/1982 | Thiele | B66C 19/007 105/163.2 |
| 4,534,476 | A | 8/1985 | Burchfield et al. | |
| 4,546,891 | A * | 10/1985 | Lanigan, Sr. | B66C 19/007 212/327 |
| 4,715,762 | A * | 12/1987 | Lanigan, Sr. | B66C 19/007 212/324 |
| 4,838,438 | A * | 6/1989 | Ishige | B66C 13/22 212/284 |

(Continued)

FOREIGN PATENT DOCUMENTS

| | | |
|---|---|---|
| CN | 204938758 U | 1/2016 |
| KR | 100542254 B1 | 1/2006 |

(Continued)

OTHER PUBLICATIONS

International Search Report and Written Opinion dated Jun. 7, 2019, corresponding to Application No. PCT/US2019/018680.

*Primary Examiner* — Michael R Mansen
*Assistant Examiner* — Juan J Campos, Jr.
(74) *Attorney, Agent, or Firm* — Patterson & Sheridan, L.L.P.

(57) ABSTRACT

An overhead crane supported by a derrick, comprising a frame coupled to the derrick and comprising a pair of rail members and a bridge member coupled between the rail members, and a trolley coupled to the frame and comprising a fairlead assembly and a cable guide movable in an X-Y plane within an inner perimeter of the frame.

20 Claims, 7 Drawing Sheets

(56) References Cited

U.S. PATENT DOCUMENTS

| | | | | |
|---|---|---|---|---|
| 7,621,410 | B1 | 11/2009 | Updegrove et al. | |
| 2009/0159548 | A1 | 6/2009 | Waisanen | |
| 2014/0190919 | A1 | 7/2014 | Rosberg | |
| 2016/0137464 | A1* | 5/2016 | Ojapalo | B66C 19/007 212/291 |
| 2016/0280516 | A1* | 9/2016 | Rieger | B66C 19/005 |

FOREIGN PATENT DOCUMENTS

| | | | |
|---|---|---|---|
| KR | 20110081381 | A | 7/2011 |
| WO | 2018/016850 | A1 | 1/2018 |

* cited by examiner

OVERHEAD CRANE WITH REMOTELY LOCATED WINCH

BACKGROUND

Field

Embodiments of the disclosure relate to a trolley for use on or as an overhead crane, such as a bridge crane, a cantilevered crane, or other overhead crane utilized to lift, lower, and move objects.

Description of the Related Art

Overhead cranes are utilized extensively in many industries to move objects. A bridge crane, sometime referred to as an offline activity crane (OAC), is one type of overhead crane that is utilized in the oil and gas industry. The bridge crane (or OAC) is mounted on an oil and gas rig above a fingerboard area for overhead lifting of tubulars.

Conventional bridge cranes typically include a bridge that travels along two parallel rails. The bridge supports a trolley that travels along the bridge in a direction normal to the rails. The trolley supports a winch that has a motor and drum, which contains wire rope used to raise and lower a lifting hook coupled to the end of the wire rope. The winch is heavy and adds a significant amount of load that the trolley and ultimately the bridge crane must support, which reduces the overall lifting capacity of the bridge crane.

Therefore, there exists a need for new and improved overhead cranes.

SUMMARY

Embodiments of the disclosure relate to an overhead crane comprising a trolley that moves within an X-Y plane relative to a support structure.

In one embodiment, an overhead crane supported by a derrick is provided that includes a frame coupled to the derrick and comprising a pair of rail members and a bridge member coupled between the rail members, and a trolley coupled to the frame and comprising a fairlead assembly and a cable guide movable in an X-Y plane within an inner perimeter of the frame.

In another embodiment, overhead crane supported by a derrick is provided that includes a frame coupled to the derrick and comprising a pair of rail members and a bridge member coupled between the rail members, wherein the bridge member is movable relative to the rail members, a trolley coupled to the frame and comprising a fairlead assembly and a cable guide movable in an X-Y plane within an inner perimeter of the frame, wherein the cable guide is movable relative to the bridge member, and wherein the fairlead assembly comprises one or more arms coupled to one or more sheaves, and a winch coupled to the derrick at a location remote from the trolley, wherein the winch has a cable that is routed along the one or more sheaves of the fairlead assembly from which a hook is suspended.

In another embodiment, overhead crane supported by a derrick is provided that includes a frame coupled to the derrick and comprising a pair of rail members and a bridge member coupled between the rail members, and a trolley coupled to the frame and comprising a fairlead assembly and a cable guide coupled to the bridge member, wherein the cable guide is movable in an X-Y plane within an inner perimeter of the frame, wherein the fairlead assembly comprises a pair of arms, a central pivot point located between the arms, and peripheral pivot points located at opposite ends of the arms, wherein a distance between the central pivot point and each of the peripheral pivot points is equal.

BRIEF DESCRIPTION OF THE DRAWINGS

To facilitate understanding, identical reference numerals have been used, where possible, to designate identical elements that are common to the figures. It is contemplated that elements disclosed in one embodiment may be beneficially utilized with other embodiments without specific recitation.

DETAILED DESCRIPTION

Embodiments of the disclosure relate to an overhead crane comprising a trolley that moves within an X-Y plane relative to a support structure. The trolley is coupled to a remotely located winch in order to reduce the overall weight of the overhead crane. The overhead crane may be utilized to replace any conventional bridge crane, such as an offline activity crane (OAC) utilized for handling tubulars on a land based or offshore oil and gas rig according to one embodiment. The overhead crane disclosed herein may also be utilized to replace other types of cranes that are supported by a support structure.

Figure 1:
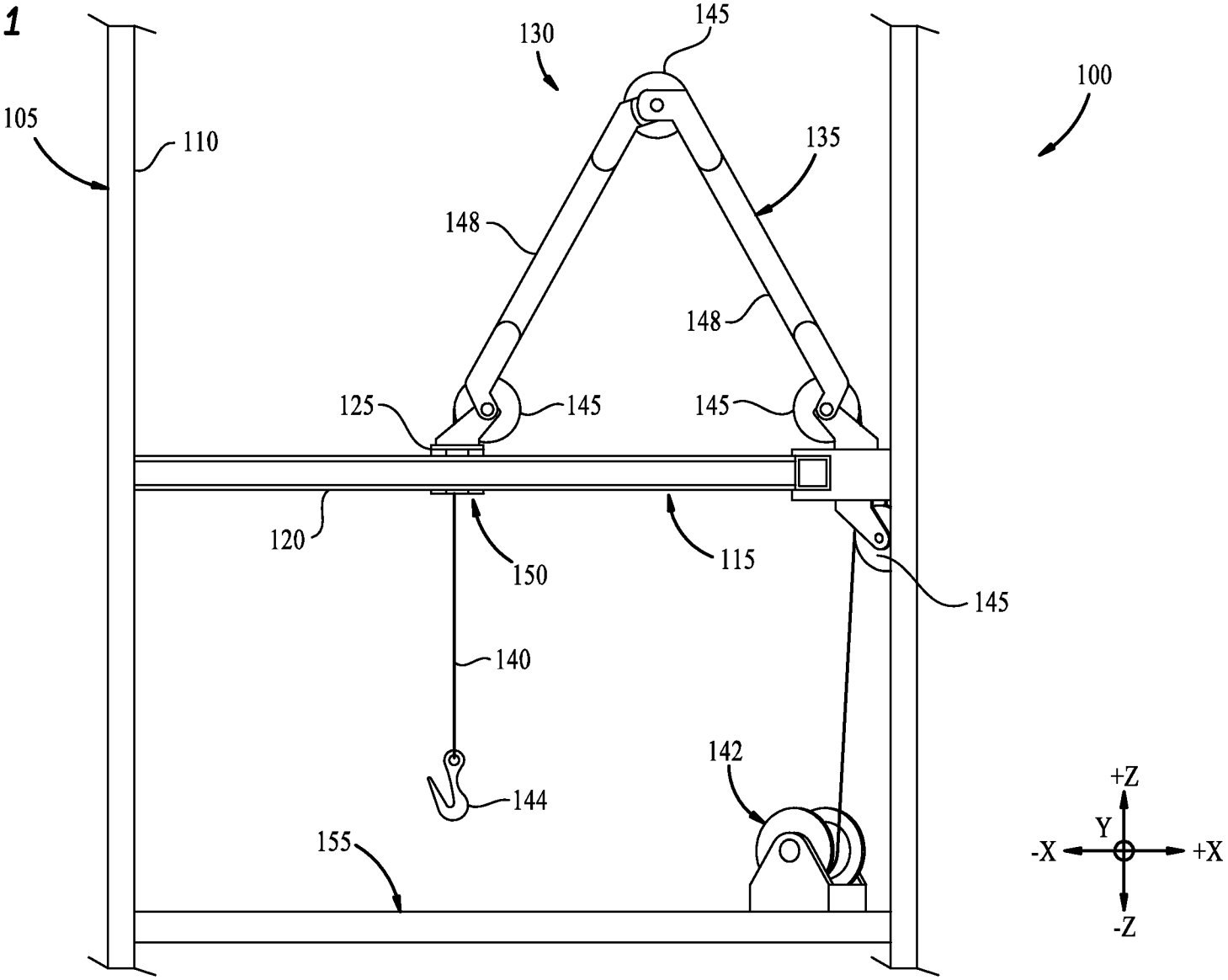
FIG. 1 is a side view of an overhead crane according to one embodiment described herein.

FIG. 1 is a side view of an overhead crane 100 according to one embodiment described herein. The overhead crane 100 is supported by a support structure 105 which, in this embodiment, is a derrick 110. The overhead crane 100 includes a frame 115, a trolley 130, and a winch 142. The frame 115, which is coupled to the derrick 110, includes a pair of rail members 120 (only one is shown in FIG. 1) that extend in the X direction, and a bridge member 125 that extends in the Y direction between the rail members 120. The rail members 120 and the bridge member 125 support the trolley 130.

The trolley 130 is coupled to the frame 115 and comprises a fairlead assembly 135 and a cable guide 150. The fairlead assembly 135 is coupled to the cable guide 150 at one end and follows the cable guide 150 as it moves along the bridge member 125 and as the bridge member 125 moves along the rail members 120. The fairlead assembly 135 includes a pair of arms 148 coupled to four sheaves 145. Although two arms 148 and four sheaves 145 are shown, the fairlead assembly 135 may include any number of arms (e.g. one or more arms) coupled to any number of sheaves (e.g. one or more sheaves). A cable 140, such as a wire rope, extending from the winch 142 to a hook 144 is routed around the sheaves 145 that are coupled between or to one or more of the arms 148. The winch 142 may be coupled to the derrick 110 at a location remote from the trolley 130, such as by being mounted on the floor of the derrick 110. As illustrated, the winch 142 comprises a rotatable drum about which the cable 140 is spooled. The winch 142 however may comprise other types of hoisting devices. The cable guide 150 is movably coupled to the bridge member 125 and guides the cable 140 along the fairlead assembly 135 as it is payed-out and taken-in by operation of the winch 142. According to one example, a single joint elevator may be suspended from the hook 144 to move one or more tubulars on the derrick 110.

The cable guide 150, is capable of being moved in the X direction and the Y direction (e.g., within the X-Y plane) based on articulation of the arms 148 of the fairlead assembly 135. A surface area 155 that is serviced by the overhead crane 100 is defined by the dimensions of the rail members 120 and the bridge member 125. For example, a length of the rail members 120 defines movement of the cable guide 150 in the X direction, and the spacing between the rail members 120 (spanned by the bridge member 125) defines movement of the cable guide 150 in the Y direction. The overhead crane 100 may service a surface area 155 of about 16 feet by about 20 feet in one embodiment, or a surface area 155 of about 36 feet by about 36 feet in another embodiment. The dimensions of the overhead crane 100 may be configured to service a surface area of any size.

Figure 2:
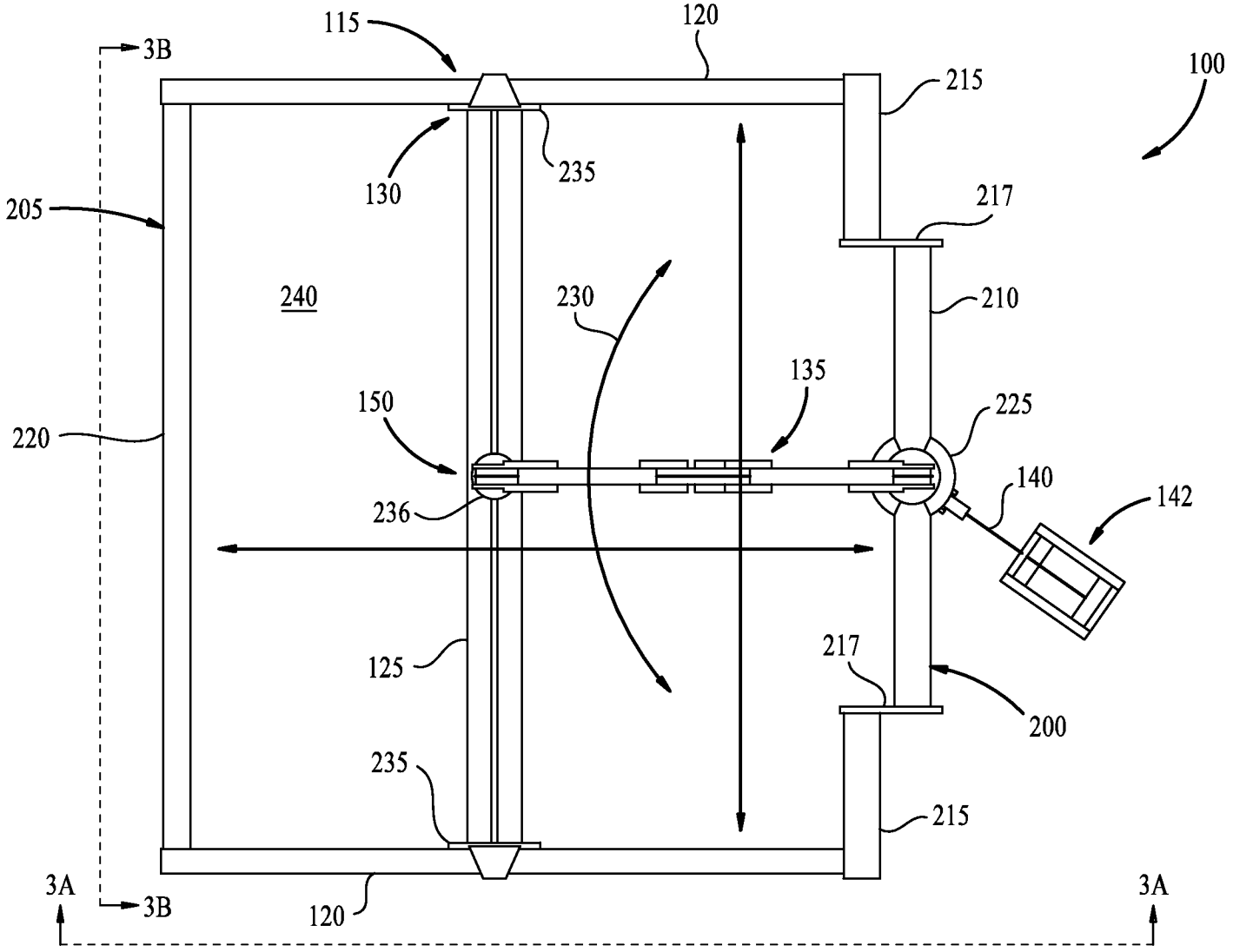
FIG. 2 is a top view of the overhead crane.

FIG. 2 is a top view of the overhead crane 100. The trolley 130 is shown coupled to the frame 115. The frame 115 further includes a supporting structure shown as a first support structure 200 and a second support structure 205 opposing the first support structure 200. In the embodiment shown in FIG. 2, the first support structure 200 includes an extended central support member 210 coupled to peripheral support members 215 by support plates 217. Each of the peripheral support members 215 are coupled to one end of each of the rail members 120. The second support structure 205 includes a single support member 220 that is coupled to opposing ends of the rail members 120. Each of the support members 210, 215, and 220 may include but are not limited to metallic structural members, such as angle iron, tubing, channel iron, I-beams, W-beams, and/or other structural shapes. Similarly, each of the rail members 120 and/or the bridge member 125 may include but are not limited to metallic structural members such as angle iron, tubing, channel iron, I-beams, W-beams, and/or other structural shapes.

One end of the fairlead assembly 135 is coupled to the central support member 210 of the first support structure 200 by a swivel device 225. The swivel device 225 may be a passive bearing device that allows movement of the one end of the fairlead assembly 135 in the direction indicated by arrow 230. The swivel device 225 may be a slewing bearing or other type of bearing.

The bridge member 125 is movable along the rail members 120 by one or more motors 235 coupled between the bridge member 125 and the rail members 120. The cable guide 150 is movable along the bridge member 125 by one or more motors 236 coupled between the cable guide 150 and the bridge member 125. Actuation of the motors 235, 236 allows the cable guide 150 to be positioned within an inner perimeter 240 defined by the rail members 120 and the first and second support structures 200, 205. Additionally, the cable guide 150 is movable relative to the bridge member 125 within the inner perimeter 240. The inner perimeter 240 substantially corresponds to the surface area 155 shown in FIG. 1.

Although multiple motors 235, 236 are shown in FIG. 2, at least one motor may be used to move both the bridge member 125 along the rail members 120, as well as move the cable guide 150 along the bridge member 125. The motors 235, 236 may be electrical, electromechanical, hydraulic, and/or other types of motors or actuators. The motors 235 are lighter in weight than any motors mounted on conventional bridge cranes. Additionally, numerous other components of the winch mounted on conventional bridge cranes are effectively eliminated or reduced, which decreases the dead weight of the overhead crane 100 as described herein when compared to conventional bridge cranes.

Figure 3A:
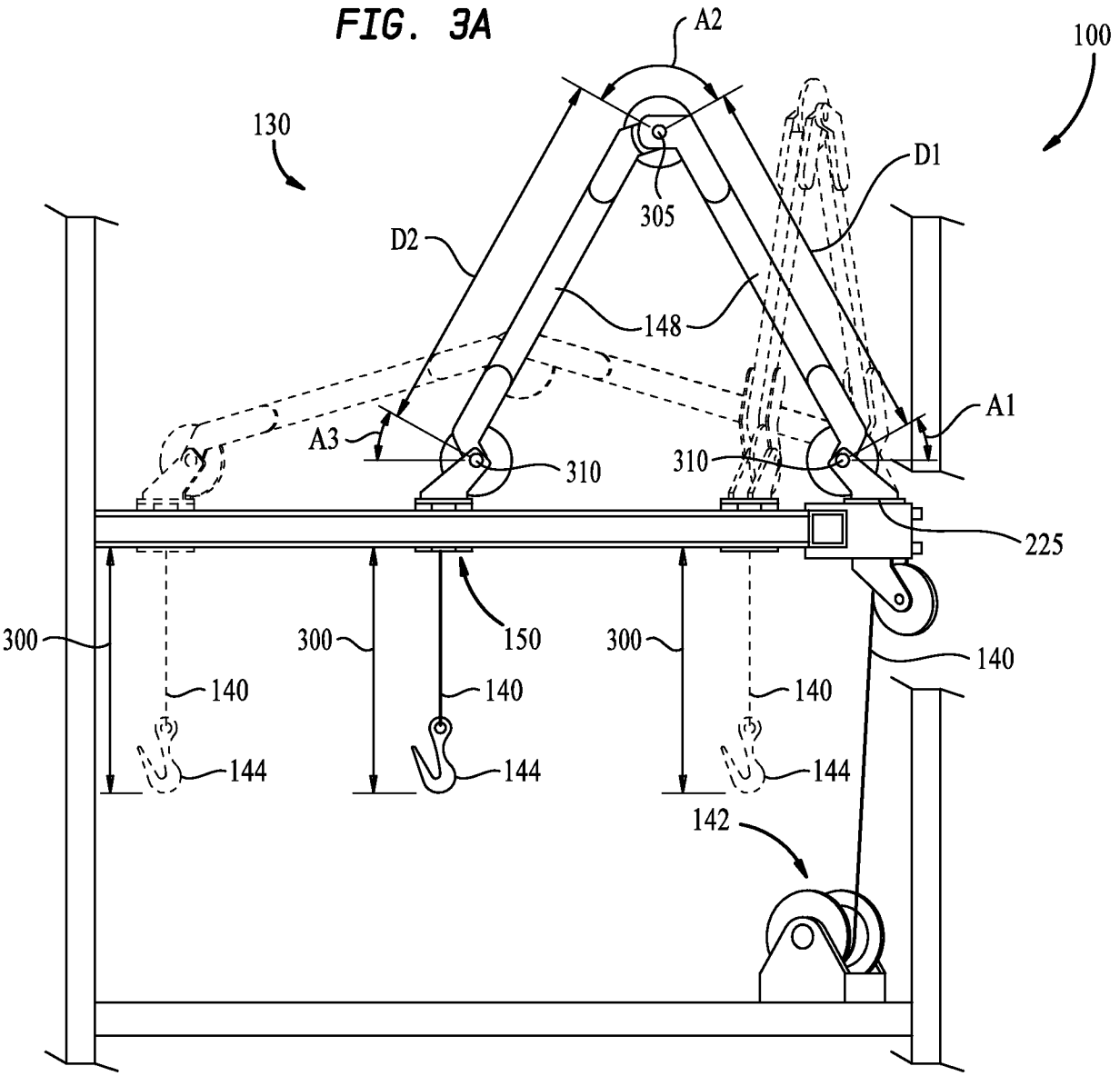
FIG. 3A is a side view of the overhead crane along lines 3A-3A of FIG. 2.
Figure 3B:
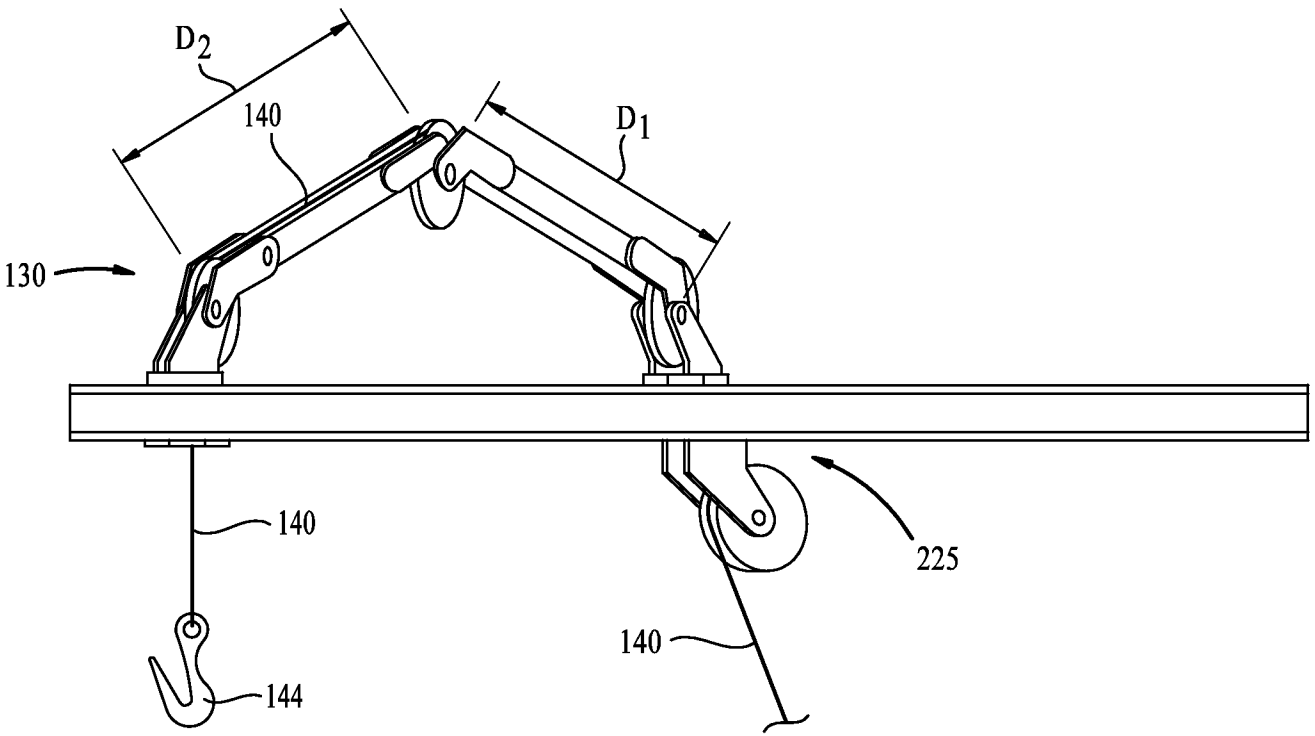
FIG. 3B is a side view of the overhead crane along lines 3B-3B of FIG. 2.

FIGS. 3A and 3B are various side views of the overhead crane 100. FIG. 3A is a side view of the overhead crane 100 along lines 3A-3A of FIG. 2. FIG. 3B is a side view of the overhead crane 100 along lines 3B-3B of FIG. 2.

The trolley 130 is configured so that a hook height 300 as shown in FIG. 3A remains constant as the cable guide 150 is moved along the bridge member 125 and as the bridge member 125 is moved along the rail members 120. The hook height 300 is defined from the cable guide 150 to the hook 144 coupled to the cable 140. The hook height 300 remains constant so long as the winch 142 is not paying-out or taking-up the cable 140. Thus, when the winch 142 is not paying-out or taking-up cable 140, the hook height 300 stays the same during articulation of the trolley 130 in at least the positions shown in FIG. 3A (as well as other positions within the range of articulation of the trolley 130). To ensure that the hook height 300 remains constant, distances D1 and D2 between a central pivot point 305 (located between the arms 148) and peripheral pivot points 310 (located at the opposite ends of the arms 148) of the fairlead assembly 135 are equal. The lengths of the arms 148 of the fairlead assembly 135 may be the same. A wrap angle is located about each of the peripheral pivot points 310 and the central pivot point 305. As shown in FIG. 3A, wrap angles A1, A2, and A3 when added together equal the sum of 180 degrees regardless of the position of the fairlead assembly 135.

Figure 4A:
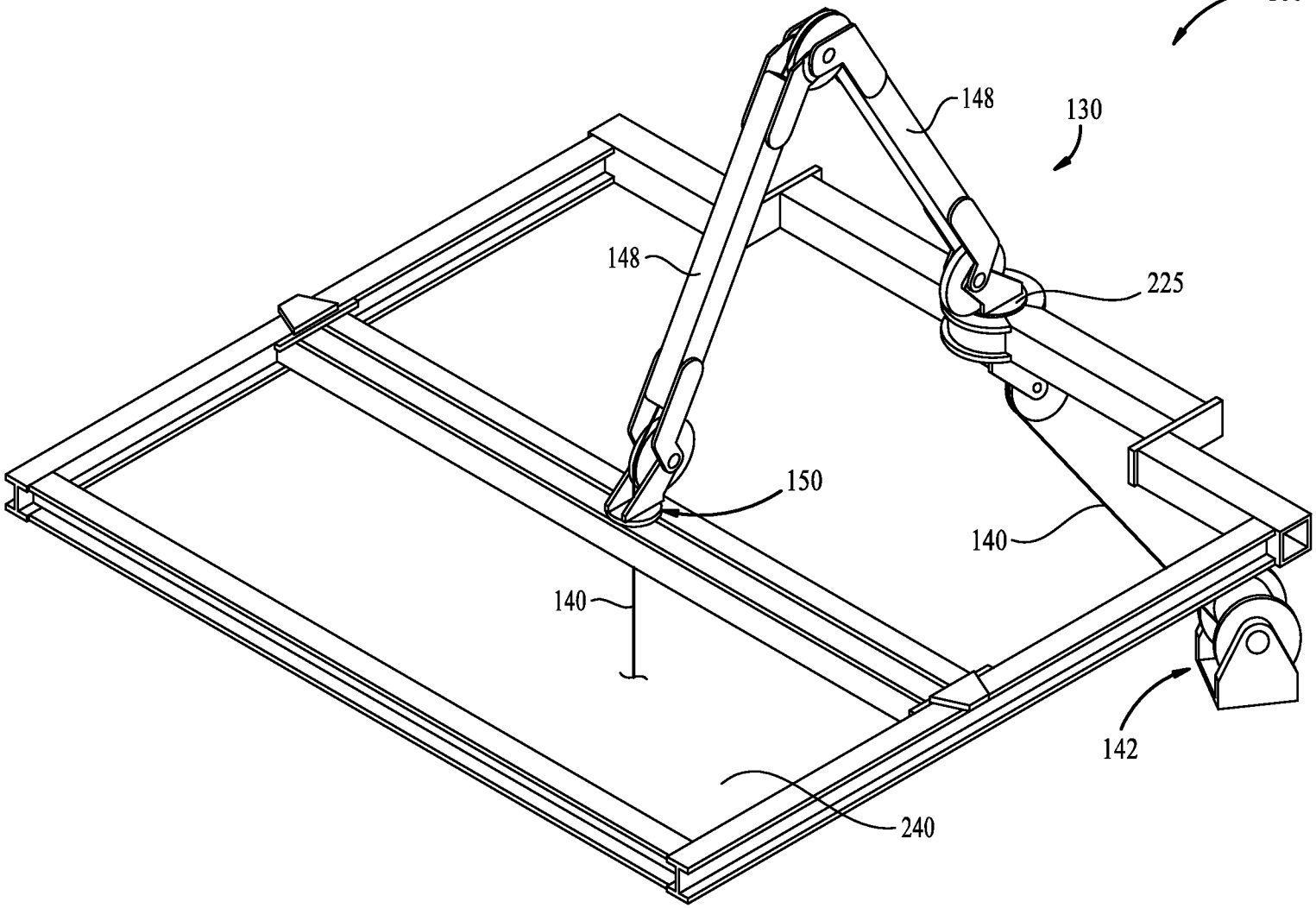
FIGS. 4A, 4B, and 4C are isometric top views of the overhead crane showing a range of movement of the overhead crane.
Figure 4B:
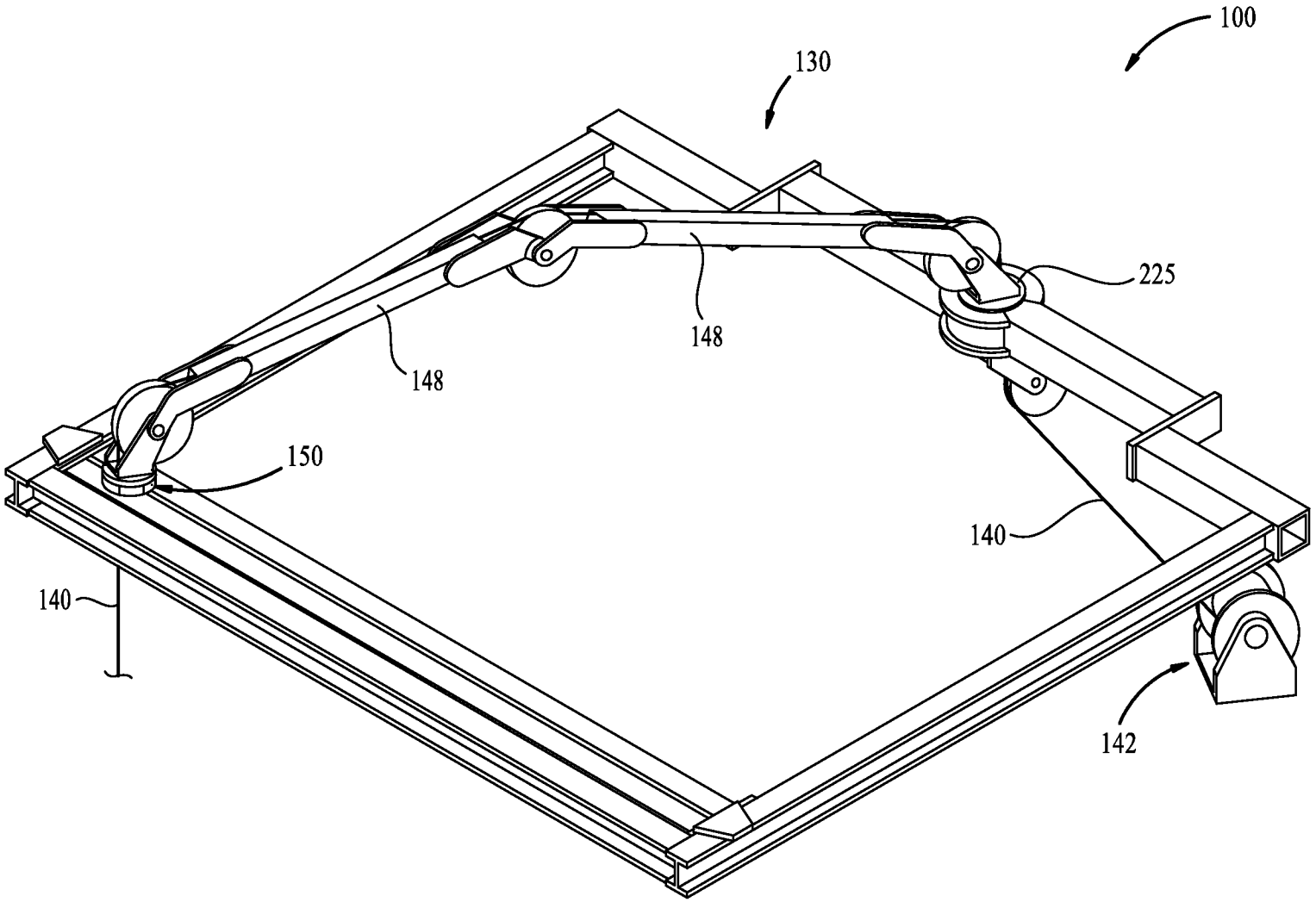
Figure 4C:
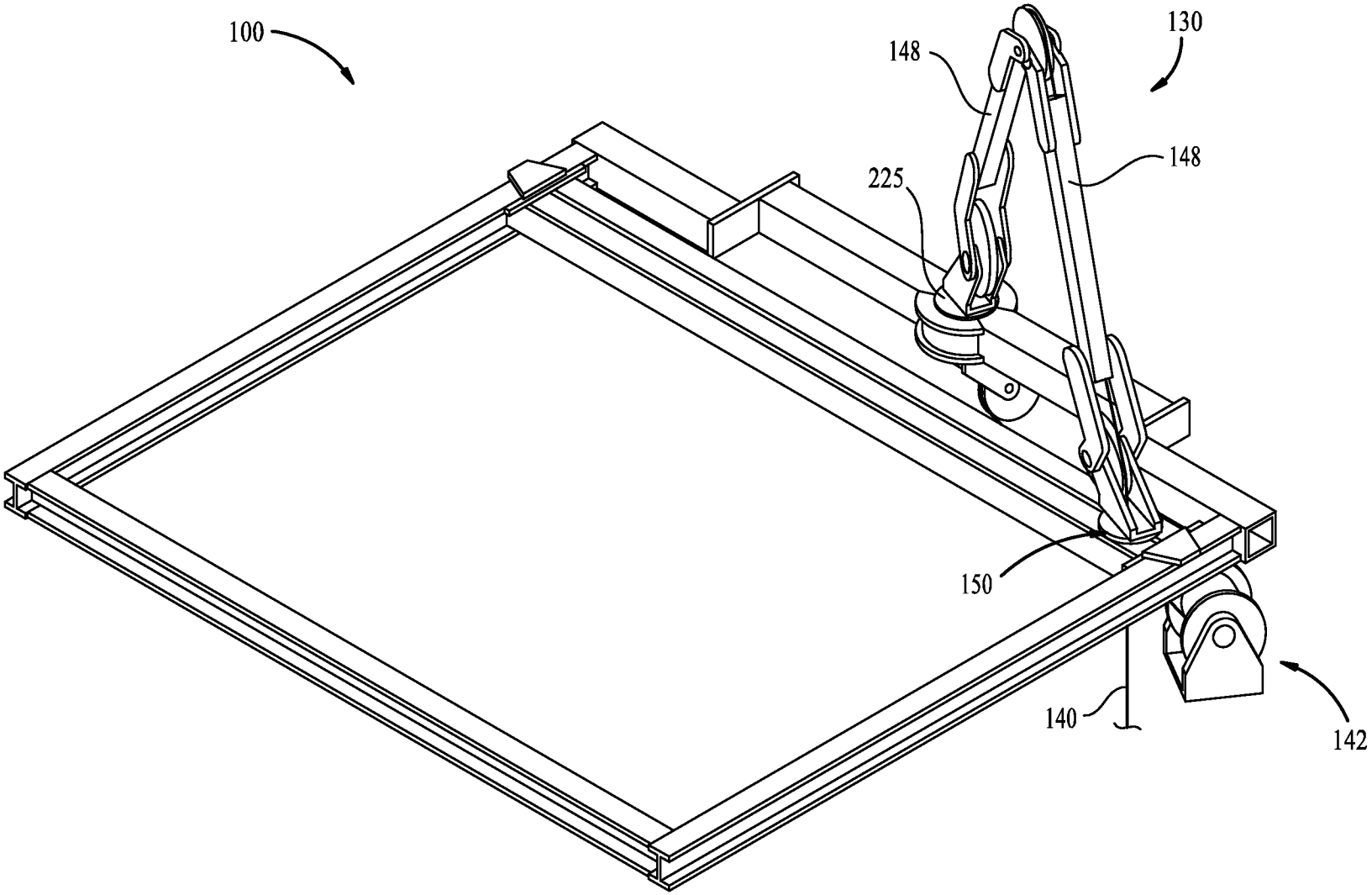

FIGS. 4A, 4B, and 4C are various isometric top views of the overhead crane 100 showing the range of movement of the trolley 130. The range of movement of the trolley 130 provides precise positioning of the cable guide 150 and the hook 144. FIG. 4A shows the trolley 130 in a central position within the inner perimeter 240. FIG. 4B shows the trolley 130 in one fully extended position at one corner of the inner perimeter 240. FIG. 4C shows the trolley 130 in another fully extended position at the opposite corner of the inner perimeter 240. The trolley 130 is moveable to any location within the inner perimeter 240 to thereby move the hook 144 (shown in FIG. 3A) and anything being supported by the hook 144 as needed.

While the foregoing is directed to embodiments of the disclosure, other and further embodiments of the disclosure thus may be devised without departing from the basic scope thereof, and the scope thereof is determined by the claims that follow.

The invention claimed is:

1. An overhead crane supported by a derrick, comprising:

a frame comprising a pair of rail members and a bridge member coupled between the rail members; and a trolley coupled to the frame and comprising a fairlead assembly and a cable guide movable in an X-Y plane within an inner perimeter of the frame, wherein the fairlead assembly comprises a pair of arms, a central pivot point located between the arms, and peripheral pivot points located at opposite ends of the arms, and the central pivot point is movable along a Z-axis.

2. The overhead crane of claim 1, wherein the bridge member is movable relative to the rail members and the cable guide is movable relative to the bridge member.

3. The overhead crane of claim 2, wherein the bridge member is movable relative to the rail members in an X direction.

4. The overhead crane of claim 3, wherein the cable guide is movable relative to the bridge member in a Y direction.

5. The overhead crane of claim 1, wherein a distance between the central pivot point and each of the peripheral pivot points is equal during movement of the central pivot point.

6. The overhead crane of claim 5, wherein the fairlead assembly comprises a wrap angle about each of the peripheral pivot points and the central pivot point, and wherein a sum of the wrap angles equals 180 degrees.

7. The overhead crane of claim 1, further comprising a winch coupled to the derrick at a location remote from the trolley, wherein the winch has a cable that is routed along one or more sheaves of the fairlead assembly from which a hook is suspended.

8. The overhead crane of claim 7, wherein a hook height is defined from the cable guide to the hook coupled to the cable.

9. The overhead crane of claim 8, wherein the hook height remains constant when the winch is not paying-out or taking-up the cable as the trolley is moved relative to the frame.

10. The overhead crane of claim 1, further comprising at least one motor configured to move the bridge member relative to the rail members and the trolley relative to the bridge member.

11. An overhead crane supported by a derrick, comprising:

a frame comprising a pair of rail members and a bridge member coupled between the rail members, wherein the bridge member is movable relative to the rail members;

a trolley coupled to the frame and comprising a fairlead assembly and a cable guide movable in an X-Y plane within an inner perimeter of the frame, wherein the cable guide is movable relative to the bridge member, and wherein the fairlead assembly comprises:

one or more arms coupled to one or more sheaves, a central pivot point located between a pair of arms, and peripheral pivot points located at opposite ends of the pair of arms, wherein a distance between the central pivot point and each of the peripheral pivot points is equal; and a winch coupled to the derrick at a location remote from the trolley, wherein the winch has a cable that is routed along the one or more sheaves of the fairlead assembly from which a hook is suspended.

12. The overhead crane of claim 11, wherein the bridge member is movable relative to the rail members in an X direction.

13. The overhead crane of claim 12, wherein the cable guide is movable relative to the bridge member in a Y direction.

14. The overhead crane of claim 11, wherein the distance between the central pivot point and each of the peripheral pivot points is equal during movement of the central pivot point.

15. The overhead crane of claim 11, wherein the fairlead assembly further comprises a wrap angle about each of the peripheral pivot points and the central pivot point, and wherein a sum of the wrap angles equals 180 degrees.

16. An overhead crane supported by a derrick, comprising:

a frame comprising a pair of rail members and a bridge member coupled between the rail members; and a trolley coupled to the frame and comprising a fairlead assembly and a cable guide coupled to the bridge member, wherein the cable guide is movable in an X-Y plane within an inner perimeter of the frame, wherein the fairlead assembly comprises a pair of arms, a central pivot point located between the arms, and peripheral pivot points located at opposite ends of the arms, wherein a distance between the central pivot point and each of the peripheral pivot points is equal.

17. The overhead crane of claim 16, wherein the fairlead assembly comprises a wrap angle about each of the peripheral pivot points and the central pivot point, and wherein a sum of the wrap angles equals 180 degrees.

18. The overhead crane of claim 16, wherein the bridge member is movable relative to the rail members, and wherein the cable guide is movable relative to the bridge member.

19. The overhead crane of claim 18, wherein the bridge member is movable relative to the rail members in an X direction.

20. The overhead crane of claim 19, wherein the cable guide is movable relative to the bridge member in a Y direction.

* * * * *